US007703555B2

(12) United States Patent
Overstreet

(10) Patent No.: US 7,703,555 B2
(45) **Date of Patent: *Apr. 27, 2010**

(54) DRILLING TOOLS HAVING HARDFACING WITH NICKEL-BASED MATRIX MATERIALS AND HARD PARTICLES

(75) Inventor: James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 170 days.

This patent is subject to a terminal disclaimer.

(21) Appl. No.: 11/513,677

(22) Filed: Aug. 30, 2006

(65) Prior Publication Data

US 2007/0056777 A1 Mar. 15, 2007

Related U.S. Application Data

(63) Continuation-in-part of application No. 11/223,215, filed on Sep. 9, 2005, now Pat. No. 7,597,159.

(51) Int. Cl.
*E21B 10/36* (2006.01)
*C22C 29/08* (2006.01)

(52) U.S. Cl. ..... 175/425; 175/426; 75/240

(58) Field of Classification Search ..... 175/425, 175/426, 374, 375, 435; 75/240; 428/627
See application file for complete search history.

(56) References Cited

U.S. PATENT DOCUMENTS 2,033,594 A 3/1936 Stoody
2,407,642 A 9/1946 Ashworth
2,660,405 A 11/1953 Scott et al.
2,740,651 A 4/1956 Ortloff (Continued)

FOREIGN PATENT DOCUMENTS

AU 695583 2/1998

(Continued)

OTHER PUBLICATIONS www.matweb.com "Wall Comonoy Colmonoy 4 Hard-surfacing alloy with chromium boride" from www.matweb.com.*

(Continued)

*Primary Examiner*—Jennifer H Gay
*Assistant Examiner*—Cathleen R Hutchins
(74) *Attorney, Agent, or Firm*—TraskBritt

(57) ABSTRACT

An abrasive wear-resistant material includes a matrix and sintered and cast tungsten carbide granules. A device for use in drilling subterranean formations includes a first structure secured to a second structure with a bonding material. An abrasive wear-resistant material covers the bonding material. The first structure may include a drill bit body and the second structure may include a cutting element. A method for applying an abrasive wear-resistant material to a drill bit includes providing a bit, mixing sintered and cast tungsten carbide granules in a matrix material to provide a pre-application material, heating the pre-application material to melt the matrix material, applying the pre-application material to the bit, and solidifying the material. A method for securing a cutting element to a bit body includes providing an abrasive wear-resistant material to a surface of a drill bit that covers a brazing alloy disposed between the cutting element and the bit body.

18 Claims, 8 Drawing Sheets

U.S. PATENT DOCUMENTS

| | | | | |
|---|---|---|---|---|
| 2,819,958 | A | | 1/1958 | Abkowitz et al. |
| 2,819,959 | A | | 1/1958 | Abkowitz et al. |
| 2,906,654 | A | | 9/1959 | Abkowitz |
| 2,961,312 | A | | 11/1960 | Elbaum |
| 3,158,214 | A | | 11/1964 | Wisler et al. |
| 3,180,440 | A | | 4/1965 | Bridwell |
| 3,260,579 | A | | 7/1966 | Scales et al. |
| 3,368,881 | A | | 2/1968 | Abkowitz et al. |
| 3,471,921 | A | | 10/1969 | Feenstra |
| 3,660,050 | A | | 5/1972 | Iler et al. |
| 3,727,704 | A | | 4/1973 | Abplanalp |
| 3,757,879 | A | | 9/1973 | Wilder et al. |
| 3,768,984 | A | | 10/1973 | Foster, Jr. |
| 3,790,353 | A | | 2/1974 | Jackson et al. |
| 3,800,891 | A | | 4/1974 | White et al. |
| 3,942,954 | A | | 3/1976 | Frehn |
| 3,987,859 | A | | 10/1976 | Lichte |
| 3,989,554 | A | | 11/1976 | Wisler |
| 4,017,480 | A | | 4/1977 | Baum |
| 4,043,611 | A | | 8/1977 | Wallace |
| 4,047,828 | A | | 9/1977 | Makely |
| 4,059,217 | A | | 11/1977 | Woodward |
| 4,094,709 | A | | 6/1978 | Rozmus |
| 4,128,136 | A | | 12/1978 | Generoux |
| 4,173,457 | A | | 11/1979 | Smith |
| 4,198,233 | A | | 4/1980 | Frehn |
| 4,221,270 | A | | 9/1980 | Vezirian |
| 4,229,638 | A | | 10/1980 | Lichte |
| 4,233,720 | A | | 11/1980 | Rozmus |
| 4,243,727 | A | | 1/1981 | Wisler et al. |
| 4,252,202 | A | | 2/1981 | Purser, Sr. |
| 4,255,165 | A | | 3/1981 | Dennis et al. |
| 4,262,761 | A | | 4/1981 | Crow |
| 4,306,139 | A | | 12/1981 | Shinozaki et al. |
| 4,341,557 | A | | 7/1982 | Lizenby |
| 4,389,952 | A | | 6/1983 | Dreier et al. |
| 4,398,952 | A | | 8/1983 | Drake |
| 4,414,029 | A | | 11/1983 | Newman et al. |
| 4,455,278 | A | | 6/1984 | van Nederveen et al. |
| 4,499,048 | A | | 2/1985 | Hanejko |
| 4,499,795 | A | | 2/1985 | Radtke |
| 4,499,958 | A | | 2/1985 | Radtke et al. |
| 4,526,748 | A | | 7/1985 | Rozmus |
| 4,547,337 | A | | 10/1985 | Rozmus |
| 4,552,232 | A | | 11/1985 | Frear |
| 4,554,130 | A | | 11/1985 | Ecer |
| 4,562,892 | A | | 1/1986 | Ecer |
| 4,562,990 | A | | 1/1986 | Rose |
| 4,579,713 | A | | 4/1986 | Lueth |
| 4,596,694 | A | | 6/1986 | Rozmus |
| 4,597,456 | A | | 7/1986 | Ecer |
| 4,597,730 | A | | 7/1986 | Rozmus |
| 4,611,673 | A | | 9/1986 | Childers et al. |
| 4,630,692 | A | | 12/1986 | Ecer |
| 4,630,693 | A | | 12/1986 | Goodfellow |
| 4,656,002 | A | | 4/1987 | Lizenby et al. |
| 4,666,797 | A | | 5/1987 | Newman et al. |
| 4,667,756 | A | | 5/1987 | King et al. |
| 4,674,802 | A | | 6/1987 | McKenna et al. |
| 4,676,124 | A | * | 6/1987 | Fischer ..... 76/108.2 |
| 4,686,080 | A | | 8/1987 | Hara et al. |
| 4,694,919 | A | | 9/1987 | Barr |
| 4,726,432 | A | | 2/1988 | Scott et al. |
| 4,743,515 | A | | 5/1988 | Fischer et al. |
| 4,744,943 | A | | 5/1988 | Timm |
| 4,762,028 | A | | 8/1988 | Regan |
| 4,781,770 | A | | 11/1988 | Kar |
| 4,809,903 | A | | 3/1989 | Eylon et al. |
| 4,814,234 | A | | 3/1989 | Bird |
| 4,836,307 | A | | 6/1989 | Keshavan et al. |
| 4,838,366 | A | | 6/1989 | Jones |
| 4,871,377 | A | | 10/1989 | Frushour |
| 4,884,477 | A | | 12/1989 | Smith et al. |
| 4,889,017 | A | | 12/1989 | Fuller et al. |
| 4,919,013 | A | | 4/1990 | Smith et al. |
| 4,923,512 | A | | 5/1990 | Timm et al. |
| 4,933,240 | A | * | 6/1990 | Barber, Jr. ..... 428/608 |
| 4,938,991 | A | | 7/1990 | Bird |
| 4,944,774 | A | | 7/1990 | Keshavan et al. |
| 4,956,012 | A | | 9/1990 | Jacobs et al. |
| 4,968,348 | A | | 11/1990 | Abkowitz et al. |
| 5,000,273 | A | | 3/1991 | Horton et al. |
| 5,010,225 | A | | 4/1991 | Carlin |
| 5,030,598 | A | | 7/1991 | Hsieh |
| 5,032,352 | A | | 7/1991 | Meeks et al. |
| 5,038,640 | A | | 8/1991 | Sullivan et al. |
| 5,049,450 | A | | 9/1991 | Dorfman et al. |
| 5,051,112 | A | | 9/1991 | Keshavan et al. |
| 5,089,182 | A | | 2/1992 | Findeisen et al. |
| 5,090,491 | A | | 2/1992 | Tibbitts et al. |
| 5,101,692 | A | | 4/1992 | Simpson |
| 5,150,636 | A | | 9/1992 | Hill |
| 5,152,194 | A | | 10/1992 | Keshavan et al. |
| 5,161,898 | A | | 11/1992 | Drake |
| 5,186,267 | A | | 2/1993 | White |
| 5,232,522 | A | | 8/1993 | Doktycz et al. |
| 5,242,017 | A | | 9/1993 | Hailey |
| 5,250,355 | A | | 10/1993 | Newman et al. |
| 5,281,260 | A | | 1/1994 | Kumar et al. |
| 5,286,685 | A | | 2/1994 | Schoennahl et al. |
| 5,291,807 | A | | 3/1994 | Vanderford et al. |
| 5,311,958 | A | | 5/1994 | Isbell et al. |
| 5,328,763 | A | | 7/1994 | Terry |
| 5,348,806 | A | | 9/1994 | Kojo et al. |
| 5,373,907 | A | | 12/1994 | Weaver |
| 5,433,280 | A | | 7/1995 | Smith |
| 5,439,068 | A | | 8/1995 | Huffstutler et al. |
| 5,443,337 | A | | 8/1995 | Katayama |
| 5,479,997 | A | | 1/1996 | Scott et al. |
| 5,482,670 | A | | 1/1996 | Hong |
| 5,484,468 | A | | 1/1996 | Ostlund et al. |
| 5,492,186 | A | | 2/1996 | Overstreet et al. |
| 5,506,055 | A | | 4/1996 | Dorfman et al. |
| 5,535,838 | A | | 7/1996 | Keshavan et al. |
| 5,543,235 | A | | 8/1996 | Mirchandani et al. |
| 5,544,550 | A | | 8/1996 | Smith |
| 5,560,440 | A | | 10/1996 | Tibbits |
| 5,586,612 | A | | 12/1996 | Isbell et al. |
| 5,589,268 | A | | 12/1996 | Kelley et al. |
| 5,593,474 | A | | 1/1997 | Keshavan et al. |
| 5,611,251 | A | | 3/1997 | Katayama |
| 5,612,264 | A | | 3/1997 | Nilsson et al. |
| 5,641,251 | A | | 6/1997 | Leins et al. |
| 5,641,921 | A | | 6/1997 | Dennis et al. |
| 5,653,299 | A | | 8/1997 | Sreshta et al. |
| 5,662,183 | A | | 9/1997 | Fang |
| 5,663,512 | A | | 9/1997 | Schader et al. |
| 5,666,864 | A | | 9/1997 | Tibbits |
| 5,677,042 | A | | 10/1997 | Massa et al. |
| 5,679,445 | A | | 10/1997 | Massa et al. |
| 5,697,046 | A | | 12/1997 | Conley |
| 5,697,462 | A | | 12/1997 | Grimes et al. |
| 5,732,783 | A | | 3/1998 | Truax et al. |
| 5,733,649 | A | | 3/1998 | Kelley et al. |
| 5,733,664 | A | | 3/1998 | Kelley et al. |
| 5,740,872 | A | | 4/1998 | Smith |
| 5,753,160 | A | | 5/1998 | Takeuchi et al. |
| 5,755,298 | A | * | 5/1998 | Langford et al. ..... 175/374 |
| 5,765,095 | A | | 6/1998 | Flak et al. |
| 5,776,593 | A | | 7/1998 | Massa et al. |
| 5,778,301 | A | | 7/1998 | Hong |
| 5,789,686 | A | | 8/1998 | Massa et al. |
| 5,791,422 | A | | 8/1998 | Liang et al. |
| 5,791,423 | A | | 8/1998 | Overstreet et al. |

| | | | |
|---|---|---|---|
| 5,792,403 | A | 8/1998 | Massa et al. |
| 5,806,934 | A | 9/1998 | Massa et al. |
| 5,830,256 | A | 11/1998 | Northrop et al. |
| 5,856,626 | A | 1/1999 | Fischer et al. |
| 5,865,571 | A | 2/1999 | Tankala et al. |
| 5,880,382 | A | 3/1999 | Fang et al. |
| 5,893,204 | A | 4/1999 | Symonds |
| 5,896,940 | A | 4/1999 | Pietrobelli et al. |
| 5,897,830 | A | 4/1999 | Abkowitz et al. |
| 5,904,212 | A | 5/1999 | Arfele |
| 5,921,330 | A | 7/1999 | Sue et al. |
| 5,924,502 | A | 7/1999 | Arfele et al. |
| 5,954,147 | A | 9/1999 | Overstreet |
| 5,957,006 | A | 9/1999 | Smith |
| 5,963,775 | A | 10/1999 | Fang |
| 5,967,248 | A | 10/1999 | Drake et al. |
| 5,988,302 | A | 11/1999 | Sreshta et al. |
| 5,988,303 | A | 11/1999 | Arfele |
| 6,029,544 | A | 2/2000 | Katayama |
| 6,045,750 | A | 4/2000 | Drake et al. |
| 6,051,171 | A | 4/2000 | Takeuchi et al. |
| 6,063,333 | A | 5/2000 | Dennis |
| 6,068,070 | A | 5/2000 | Scott |
| 6,073,518 | A | 6/2000 | Chow et al. |
| 6,086,980 | A | 7/2000 | Foster et al. |
| 6,089,123 | A | 7/2000 | Chow et al. |
| 6,099,664 | A | 8/2000 | Davies et al. |
| 6,124,564 | A | 9/2000 | Sue et al. |
| 6,131,677 | A | 10/2000 | Arfele et al. |
| 6,148,936 | A | 11/2000 | Evans et al. |
| 6,196,338 | B1 | 3/2001 | Slaughter et al. |
| 6,200,514 | B1 | 3/2001 | Meister |
| 6,206,115 | B1 | 3/2001 | Overstreet et al. |
| RE37,127 | E | 4/2001 | Schader et al. |
| 6,209,420 | B1 | 4/2001 | Butcher et al. |
| 6,214,134 | B1 | 4/2001 | Eylon et al. |
| 6,214,287 | B1 | 4/2001 | Waldenstrom |
| 6,220,117 | B1 | 4/2001 | Butcher |
| 6,227,188 | B1 | 5/2001 | Tankala et al. |
| 6,228,139 | B1 | 5/2001 | Oskarsson |
| 6,234,261 | B1 | 5/2001 | Evans et al. |
| 6,241,036 | B1 | 6/2001 | Lovato et al. |
| 6,248,149 | B1 * | 6/2001 | Massey et al. ..... 75/236 |
| 6,254,658 | B1 | 7/2001 | Taniuchi et al. |
| 6,287,360 | B1 | 9/2001 | Kembaiyan et al. |
| 6,290,438 | B1 | 9/2001 | Papajewski |
| 6,293,986 | B1 | 9/2001 | Rodiger et al. |
| 6,348,110 | B1 | 2/2002 | Evans |
| 6,349,780 | B1 | 2/2002 | Beuershausen |
| 6,360,832 | B1 * | 3/2002 | Overstreet et al. ..... 175/374 |
| 6,375,706 | B2 | 4/2002 | Kembaiyan et al. |
| 6,450,271 | B1 | 9/2002 | Tibbitts et al. |
| 6,453,899 | B1 | 9/2002 | Tselesin |
| 6,454,025 | B1 | 9/2002 | Runquist et al. |
| 6,454,028 | B1 | 9/2002 | Evans |
| 6,454,030 | B1 | 9/2002 | Findley et al. |
| 6,458,471 | B2 | 10/2002 | Lovato et al. |
| 6,474,425 | B1 | 11/2002 | Truax et al. |
| 6,500,226 | B1 | 12/2002 | Dennis |
| 6,511,265 | B1 | 1/2003 | Mirchandani et al. |
| 6,568,491 | B1 | 5/2003 | Matthews, III et al. |
| 6,575,350 | B2 | 6/2003 | Evans et al. |
| 6,576,182 | B1 | 6/2003 | Ravagni et al. |
| 6,589,640 | B2 | 7/2003 | Griffin et al. |
| 6,599,467 | B1 | 7/2003 | Yamaguchi et al. |
| 6,607,693 | B1 | 8/2003 | Saito et al. |
| 6,615,936 | B1 | 9/2003 | Mourik et al. |
| 6,655,481 | B2 | 12/2003 | Findley |
| 6,659,206 | B2 | 12/2003 | Liang et al. |
| 6,663,688 | B2 | 12/2003 | Findeisen et al. |
| 6,685,880 | B2 | 2/2004 | Engstrom et al. |
| 6,725,952 | B2 | 4/2004 | Singh |
| 6,742,608 | B2 | 6/2004 | Murdoch |
| 6,742,611 | B1 | 6/2004 | Illlerhaus et al. |
| 6,756,009 | B2 | 6/2004 | Sim et al. |
| 6,766,870 | B2 | 7/2004 | Overstreet |
| 6,772,849 | B2 * | 8/2004 | Oldham et al. ..... 175/433 |
| 6,782,958 | B2 | 8/2004 | Liang et al. |
| 6,849,231 | B2 | 2/2005 | Kojima et al. |
| 6,861,612 | B2 | 3/2005 | Bolton et al. |
| 6,918,942 | B2 | 7/2005 | Hatta et al. |
| 6,948,403 | B2 | 9/2005 | Singh |
| 7,044,243 | B2 | 5/2006 | Kembaiyan et al. |
| 7,048,081 | B2 | 5/2006 | Smith et al. |
| 7,240,746 | B2 | 7/2007 | Overstreet et al. |
| 2001/0015290 | A1 | 8/2001 | Sue et al. |
| 2001/0017224 | A1 | 8/2001 | Evans et al. |
| 2002/0004105 | A1 | 1/2002 | Kunze et al. |
| 2003/0010409 | A1 | 1/2003 | Kunze et al. |
| 2003/0079565 | A1 | 5/2003 | Liang et al. |
| 2004/0013558 | A1 | 1/2004 | Kondoh et al. |
| 2004/0060742 | A1 | 4/2004 | Kembaiyan et al. |
| 2004/0196638 | A1 | 10/2004 | Lee et al. |
| 2004/0234821 | A1 * | 11/2004 | Majagi ..... 428/698 |
| 2004/0243241 | A1 | 12/2004 | Istephanous et al. |
| 2004/0245022 | A1 | 12/2004 | Izaguirre et al. |
| 2004/0245024 | A1 | 12/2004 | Kembaiyan |
| 2005/0000317 | A1 | 1/2005 | Liang et al. |
| 2005/0008524 | A1 | 1/2005 | Testani |
| 2005/0072496 | A1 | 4/2005 | Hwang et al. |
| 2005/0084407 | A1 | 4/2005 | Myrick |
| 2005/0117984 | A1 | 6/2005 | Eason et al. |
| 2005/0126334 | A1 | 6/2005 | Mirchandani |
| 2005/0211475 | A1 | 9/2005 | Mirchandani et al. |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0032677 | A1 | 2/2006 | Azar et al. |
| 2006/0043648 | A1 | 3/2006 | Takeuchi et al. |
| 2006/0057017 | A1 | 3/2006 | Woodfield et al. |
| 2006/0131081 | A1 | 6/2006 | Mirchandani et al. |
| 2007/0042217 | A1 | 2/2007 | Fang et al. |
| 2007/0056777 | A1 | 3/2007 | Overstreet |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0163812 | A1 | 7/2007 | Overstreet et al. |
| 2007/0205023 | A1 | 9/2007 | Hoffmaster et al. |
| 2008/0083568 | A1 | 4/2008 | Overstreet |

FOREIGN PATENT DOCUMENTS

| | | | |
|---|---|---|---|
| CA | 2212197 | | 10/2000 |
| EP | 0 264 674 | A2 | 4/1988 |
| EP | 0 453 428 | A1 | 10/1991 |
| EP | 0 995 876 | A2 | 4/2000 |
| EP | 1 244 531 | B1 | 10/2002 |
| GB | 945227 | | 12/1963 |
| GB | 1 070039 | | 5/1967 |
| GB | 2 104 101 | A | 3/1983 |
| GB | 2203774 | A | 10/1988 |
| GB | 2 295 157 | A | 5/1996 |
| GB | 2352727 | A | 2/2001 |
| GB | 2 357 788 | A | 4/2001 |
| GB | 2 385 350 | A | 8/2003 |
| GB | 2 393 449 | A | 3/2004 |
| JP | 10 219385 | A | 8/1998 |
| WO | 03049889 | A2 | 6/2003 |
| WO | 2004053197 | A2 | 6/2004 |
| WO | WO 2006/099629 | A1 | 9/2006 |
| WO | 2007/030707 | A | 3/2007 |

OTHER PUBLICATIONS

Wall Colmonoy "Colmonoy Alloy Selector Chart" 2003, pp. 1 and 2.*

U.S. Appl. No. 11/223,215, filed Sep. 9, 2005, entitled "Abrasive Wear-Resistant Materials, Drill Bits and Drilling Tools Including Abrasive Wear-Resistant Materials, Methods for Applying Abrasive Wear-Resistant Materials to Drill Bits and Drilling Tools, and Methods for Securing Cutting Elements to a Drill Bit."
International Search Report, dated Dec. 27, 2006 (4 pages).
Written Opinion of the International Searching Authority, dated Dec. 27, 2006 (6 pages).
Warrier, S.G., et al., "Infiltration of Titanium Alloy-Matrix Composites," Journal of Materials Science Letters, 12 (1993), pp. 865-868, Chapman & Hall.
PCT International Search Report for PCT/US2007/021071, mailed Feb. 6, 2008.
Smith International, Inc., Smith Bits Product Catalog 2005-2006, p. 45.
PCT International Search Report for counterpart PCT International Application No. PCT/US2007/023275, mailed Apr. 11, 2008.
"Boron Carbide Nozzles and Inserts," Seven Stars International webpage http://www.concentric.net/~ctkang/nozzle.shtml, printed Sep. 7, 2006.
"Heat Treating of Titanium and Titanium Alloys," Key to Metals website article, www.key-to-metals.com, (no date).
Alman, D.E., et al., "The Abrasive Wear of Sintered Titanium Matrix-Ceramic Particle Reinforced Composites," Wear, 225-229 (1999), pp. 629-639.
Choe, Heeman, et al., "Effect of Tungsten Additions on the Mechanical Properties of Ti-6A1-4V," Material Science and Engineering, A 396 (2005), pp. 99-106, Elsevier.
Diamond Innovations, "Composite Diamond Coatings, Superhard Protection of Wear Parts New Coating and Service Parts from Diamond Innovations" brochure, 2004.
Gale, W.F., et al., Smithells Metals Reference Book, Eighth Edition, 2003, p. 2,117, Elsevier Butterworth Heinemann.
Miserez, A., et al. "Particle Reinforced Metals of High Ceramic Content," Material Science and Engineering A 387-389 (2004), pp. 822-831, Elsevier.
PCT International Search Report PCT Counterpart Application No. PCT/US2006/043669, mailed Apr. 13, 2007.
PCT International Search Report for PCT Counterpart Application No. PCT/US2006/043670, mailed Apr. 2, 2007.
Reed, James S., "Chapter 13: Particle Packing Characteristics," Principles of Ceramics Processing, Second Edition, John Wiley & Sons, Inc. (1995), pp. 215-227.
PCT International Search Report for PCT/US2007/021072, mailed Feb. 27, 2008.
International Search Report from PCT/US2007/019085, dated Jan. 31, 2008 (3 pages).
US 4,966,627, 10/1990, Keshavan et al. (withdrawn)

* cited by examiner

DRILLING TOOLS HAVING HARDFACING WITH NICKEL-BASED MATRIX MATERIALS AND HARD PARTICLES

PRIORITY CLAIM

This application is a continuation-in-part of U.S. patent application Ser. No. 11/223,215, filed Sep. 9, 2005, now U.S. Pat. No. 7,597,159, issued Oct. 6, 2009, the contents of which are incorporated herein in their entirety by this reference.

TECHNICAL FIELD

The present invention generally relates to earth-boring drill bits and other tools that may be used to drill subterranean formations, and to abrasive, wear-resistant hardfacing materials that may be used on surfaces of such earth-boring drill bits. The present invention also relates to methods for applying abrasive wear-resistant hardfacing materials to surfaces of earth-boring drill bits, and to methods for securing cutting elements to an earth-boring drill bit.

BACKGROUND

A typical fixed-cutter, or "drag," rotary drill bit for drilling subterranean formations includes a bit body having a face region thereon carrying cutting elements for cutting into an earth formation. The bit body may be secured to a hardened steel shank having a threaded pin connection for attaching the drill bit to a drill string that includes tubular pipe segments coupled end to end between the drill bit and other drilling equipment. Equipment such as a rotary table or top drive may be used for rotating the tubular pipe and drill bit. Alternatively, the shank may be coupled directly to the drive shaft of a down-hole motor to rotate the drill bit.

Typically, the bit body of a drill bit is formed from steel or a combination of a steel blank embedded in a matrix material that includes hard particulate material, such as tungsten carbide, infiltrated with a binder material such as a copper alloy. A steel shank may be secured to the bit body after the bit body has been formed. Structural features may be provided at selected locations on and in the bit body to facilitate the drilling process. Such structural features may include, for example, radially and longitudinally extending blades, cutting element pockets, ridges, lands, nozzle displacements, and drilling fluid courses and passages. The cutting elements generally are secured within pockets that are machined into blades located on the face region of the bit body.

Generally, the cutting elements of a fixed-cutter type drill bit each include a cutting surface comprising a hard, super-abrasive material such as mutually bound particles of polycrystalline diamond. Such "polycrystalline diamond compact" (PDC) cutters have been employed on fixed-cutter rotary drill bits in the oil and gas well drilling industries for several decades.

FIG. 1 illustrates a conventional fixed-cutter rotary drill bit 10 generally according to the description above. The rotary drill bit 10 includes a bit body 12 that is coupled to a steel shank 14. A bore (not shown) is formed longitudinally through a portion of the drill bit 10 for communicating drilling fluid to a face 20 of the drill bit 10 via nozzles 19 during drilling operations. Cutting elements 22 (typically polycrystalline diamond compact (PDC) cutting elements) generally are bonded to the face 20 of the bit body 12 by methods such as brazing, adhesive bonding, or mechanical affixation.

A drill bit 10 may be used numerous times to perform successive drilling operations during which the surfaces of the bit body 12 and cutting elements 22 may be subjected to extreme forces and stresses as the cutting elements 22 of the drill bit 10 shear away the underlying earth formation. These extreme forces and stresses cause the cutting elements 22 and the surfaces of the bit body 12 to wear. Eventually, the cutting elements 22 and the surfaces of the bit body 12 may wear to an extent at which the drill bit 10 is no longer suitable for use.

FIG. 2 is an enlarged view of a PDC cutting element 22 like those shown in FIG. 1 secured to the bit body 12. Cutting elements 22 generally are not integrally formed with the bit body 12. Typically, the cutting elements 22 are fabricated separately from the bit body 12 and secured within pockets 21 formed in the outer surface of the bit body 12. A bonding material 24 such as an adhesive or, more typically, a braze alloy may be used to secure the cutting elements 22 to the bit body 12 as previously discussed herein. Furthermore, if the cutting element 22 is a PDC cutter, the cutting element 22 may include a polycrystalline diamond compact table 28 secured to a cutting element body or substrate 23, which may be unitary or comprise two components bound together.

The bonding material 24 typically is much less resistant to wear than are other portions and surfaces of the drill bit 10 and of cutting elements 22. During use, small vugs, voids and other defects may be formed in exposed surfaces of the bonding material 24 due to wear. Solids-laden drilling fluids and formation debris generated during the drilling process may further erode, abrade and enlarge the small vugs and voids in the bonding material 24. The entire cutting element 22 may separate from the drill bit body 12 during a drilling operation if enough bonding material 24 is removed. Loss of a cutting element 22 during a drilling operation can lead to rapid wear of other cutting elements and catastrophic failure of the entire drill bit 10. Therefore, there is a need in the art for an effective method for preventing the loss of cutting elements during drilling operations.

The materials of an ideal drill bit must be extremely hard to efficiently shear away the underlying earth formations without excessive wear. Due to the extreme forces and stresses to which drill bits are subjected during drilling operations, the materials of an ideal drill bit must simultaneously exhibit high fracture toughness. In practicality, however, materials that exhibit extremely high hardness tend to be relatively brittle and do not exhibit high fracture toughness, while materials exhibiting high fracture toughness tend to be relatively soft and do not exhibit high hardness. As a result, a compromise must be made between hardness and fracture toughness when selecting materials for use in drill bits.

In an effort to simultaneously improve both the hardness and fracture toughness of earth-boring drill bits, composite materials have been applied to the surfaces of drill bits that are subjected to extreme wear. These composite materials are often referred to as "hard-facing" materials and typically include at least one phase that exhibits relatively high hardness and another phase that exhibits relatively high fracture toughness.

FIG. 3 is a representation of a photomicrograph of a polished and etched surface of a conventional hard-facing material. The hard-facing material includes tungsten carbide particles 40 substantially randomly dispersed throughout an iron-based matrix material 46. The tungsten carbide particles 40 exhibit relatively high hardness, while the matrix material 46 exhibits relatively high fracture toughness.

Tungsten carbide particles 40 used in hard-facing materials may comprise one or more of cast tungsten carbide particles, sintered tungsten carbide particles, and macrocrystalline tungsten carbide particles. The tungsten carbide system includes two stoichiometric compounds, WC and $W_2C$, with a continuous range of compositions therebetween. Cast tungsten carbide generally includes a eutectic mixture of the WC and $W_2C$ compounds. Sintered tungsten carbide particles include relatively smaller particles of WC bonded together by a matrix material. Cobalt and cobalt alloys are often used as matrix materials in sintered tungsten carbide particles. Sintered tungsten carbide particles can be formed by mixing together a first powder that includes the relatively smaller tungsten carbide particles and a second powder that includes cobalt particles. The powder mixture is formed in a "green" state. The green powder mixture then is sintered at a temperature near the melting temperature of the cobalt particles to form a matrix of cobalt material surrounding the tungsten carbide particles to form particles of sintered tungsten carbide. Finally, macrocrystalline tungsten carbide particles generally consist of single crystals of WC.

Various techniques known in the art may be used to apply a hard-facing material such as that represented in FIG. 3 to a surface of a drill bit. A rod may be configured as a hollow, cylindrical tube formed from the matrix material of the hard-facing material that is filled with tungsten carbide particles. At least one end of the hollow, cylindrical tube may be sealed. The sealed end of the tube then may be melted or welded onto the desired surface on the drill bit. As the tube melts, the tungsten carbide particles within the hollow, cylindrical tube mix with the molten matrix material as it is deposited onto the drill bit. An alternative technique involves forming a cast rod of the hard-facing material and using either an arc or a torch to apply or weld hard-facing material disposed at an end of the rod to the desired surface on the drill bit.

Arc welding techniques also may be used to apply a hard-facing material to a surface of a drill bit. For example, a plasma transferred arc may be established between an electrode and a region on a surface of a drill bit on which it is desired to apply a hard-facing material. A powder mixture including both particles of tungsten carbide and particles of matrix material then may be directed through or proximate the plasma transferred arc onto the region of the surface of the drill bit. The heat generated by the arc melts at least the particles of matrix material to form a weld pool on the surface of the drill bit, which subsequently solidifies to form the hard-facing material layer on the surface of the drill bit.

When a hard-facing material is applied to a surface of a drill bit, relatively high temperatures are used to melt at least the matrix material. At these relatively high temperatures, atomic diffusion may occur between the tungsten carbide particles and the matrix material. In other words, after applying the hard-facing material, at least some atoms originally contained in a tungsten carbide particle (tungsten and carbon for example) may be found in the matrix material surrounding the tungsten carbide particle. In addition, at least some atoms originally contained in the matrix material (iron for example) may be found in the tungsten carbide particles. FIG. 4 is an enlarged view of a tungsten carbide particle 40 shown in FIG. 3. At least some atoms originally contained in the tungsten carbide particle 40 (tungsten and carbon for example) may be found in a region 47 of the matrix material 46 immediately surrounding the tungsten carbide particle 40. The region 47 roughly includes the region of the matrix material 46 enclosed within the phantom line 48. In addition, at least some atoms originally contained in the matrix material 46 (iron for example) may be found in a peripheral or outer region 41 of the tungsten carbide particle 40. The outer region 41 roughly includes the region of the tungsten carbide particle 40 outside the phantom line 42.

Atomic diffusion between the tungsten carbide particle 40 and the matrix material 46 may embrittle the matrix material 46 in the region 47 surrounding the tungsten carbide particle 40 and reduce the hardness of the tungsten carbide particle 40 in the outer region 41 thereof, reducing the overall effectiveness of the hard-facing material. Therefore, there is a need in the art for abrasive wear-resistant hardfacing materials that include a matrix material that allows for atomic diffusion between tungsten carbide particles and the matrix material to be minimized. There is also a need in the art for methods of applying such abrasive wear-resistant hardfacing materials, and for drill bits and drilling tools that include such materials.

SUMMARY OF THE INVENTION

In one aspect, the present invention includes an abrasive wear-resistant material that includes a matrix material, a plurality of −20 ASTM (American Society for Testing and Materials) mesh sintered tungsten carbide pellets, and a plurality of −40 ASTM mesh cast tungsten carbide granules. The tungsten carbide pellets and granules are substantially randomly dispersed throughout the matrix material. The matrix material includes at least 75% nickel by weight and has a melting point of less than about 1100° C. Each sintered tungsten carbide pellet includes a plurality of tungsten carbide particles bonded together with a binder alloy having a melting point greater than about 1200° C. In pre-application ratios, the matrix material comprises between about 20% and about 60% by weight of the abrasive wear-resistant material, the plurality of sintered tungsten carbide pellets comprises between about 30% and about 55% by weight of the abrasive wear-resistant material, and the plurality of cast tungsten carbide granules comprises less than about 35% by weight of the abrasive wear-resistant material.

In another aspect, the present invention includes a device for use in drilling subterranean formations. The device includes a first structure, a second structure secured to the first structure along an interface, and a bonding material disposed between the first structure and the second structure at the interface. The bonding material secures the first and second structures together. The device further includes an abrasive wear-resistant material disposed on a surface of the device. At least a continuous portion of the wear-resistant material is bonded to a surface of the first structure and a surface of the second structure. The continuous portion of the wear-resistant material extends at least over the interface between the first structure and the second structure and covers the bonding material. The abrasive wear-resistant material includes a matrix material having a melting temperature of less than about 1100° C., a plurality of sintered tungsten carbide pellets substantially randomly dispersed throughout the matrix material, and a plurality of cast tungsten carbide granules substantially randomly dispersed throughout the matrix material.

In an additional aspect, the present invention includes a rotary drill bit for drilling subterranean formations that includes a bit body and at least one cutting element secured to the bit body along an interface. As used herein, the term "drill bit" includes and encompasses drilling tools of any configuration, including core bits, eccentric bits, bi-center bits, reamers, mills, drag bits, roller cone bits, and other such structures known in the art. A brazing alloy is disposed between the bit body and the at least one cutting element at the interface and secures the at least one cutting element to the bit body. An abrasive wear-resistant material includes, in pre-application ratios, a matrix material that comprises between about 20% and about 60% by weight of the abrasive wear-resistant material, a plurality of −20 ASTM mesh sintered tungsten carbide pellets that comprises between about 30% and about 55% by weight of the abrasive wear-resistant material, and a plurality of −40 ASTM mesh cast tungsten carbide granules that comprises less than about 35% by weight of the abrasive wear-resistant material. The tungsten carbide pellets and granules are substantially randomly dispersed throughout the matrix material. The matrix material includes at least 75% nickel by weight and has a melting point of less than about 1100° C. Each sintered tungsten carbide pellet includes a plurality of tungsten carbide particles bonded together with a binder alloy having a melting point greater than about 1200° C.

In yet another aspect, the present invention includes a method for applying an abrasive wear-resistant material to a surface of a drill bit for drilling subterranean formations. The method includes providing a drill bit including a bit body having an outer surface, mixing a plurality of −20 ASTM mesh sintered tungsten carbide pellets and a plurality of −40 ASTM mesh cast tungsten carbide granules in a matrix material to provide a pre-application abrasive wear-resistant material, and melting the matrix material. The molten matrix material, at least some of the sintered tungsten carbide pellets, and at least some of the cast tungsten carbide granules are applied to at least a portion of the outer surface of the drill bit, and the molten matrix material is solidified. The matrix material includes at least 75% nickel by weight and has a melting point of less than about 1100° C. Each sintered tungsten carbide pellet includes a plurality of tungsten carbide particles bonded together with a binder alloy having a melting point greater than about 1200° C. The matrix material comprises between about 20% and about 60% by weight of the pre-application abrasive wear-resistant material, the plurality of sintered tungsten carbide pellets comprises between about 30% and about 55% by weight of the pre-application abrasive wear-resistant material, and the plurality of cast tungsten carbide granules comprises less than about 35% by weight of the pre-application abrasive wear-resistant material.

In another aspect, the present invention includes a method for securing a cutting element to a bit body of a rotary drill bit. The method includes providing a rotary drill bit including a bit body having an outer surface including a pocket therein that is configured to receive a cutting element, and positioning a cutting element within the pocket. A brazing alloy is provided, melted, and applied to adjacent surfaces of the cutting element and the outer surface of the bit body within the pocket defining an interface therebetween and solidified. An abrasive wear-resistant material is applied to a surface of the drill bit. At least a continuous portion of the abrasive wear-resistant material is bonded to a surface of the cutting element and a portion of the outer surface of the bit body. The continuous portion extends over at least the interface between the cutting element and the outer surface of the bit body and covers the brazing alloy. In pre-application ratios, the abrasive wear-resistant material comprises a matrix material, a plurality of sintered tungsten carbide pellets, and a plurality of cast tungsten carbide granules. The matrix material includes at least 75% nickel by weight and has a melting point of less than about 1100° C. The tungsten carbide pellets are substantially randomly dispersed throughout the matrix material. Furthermore, each sintered tungsten carbide pellet includes a plurality of tungsten carbide particles bonded together with a binder alloy having a melting point greater than about 1200° C.

The features, advantages, and alternative aspects of the present invention will be apparent to those skilled in the art from a consideration of the following detailed description considered in combination with the accompanying drawings.

BRIEF DESCRIPTION OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 9:
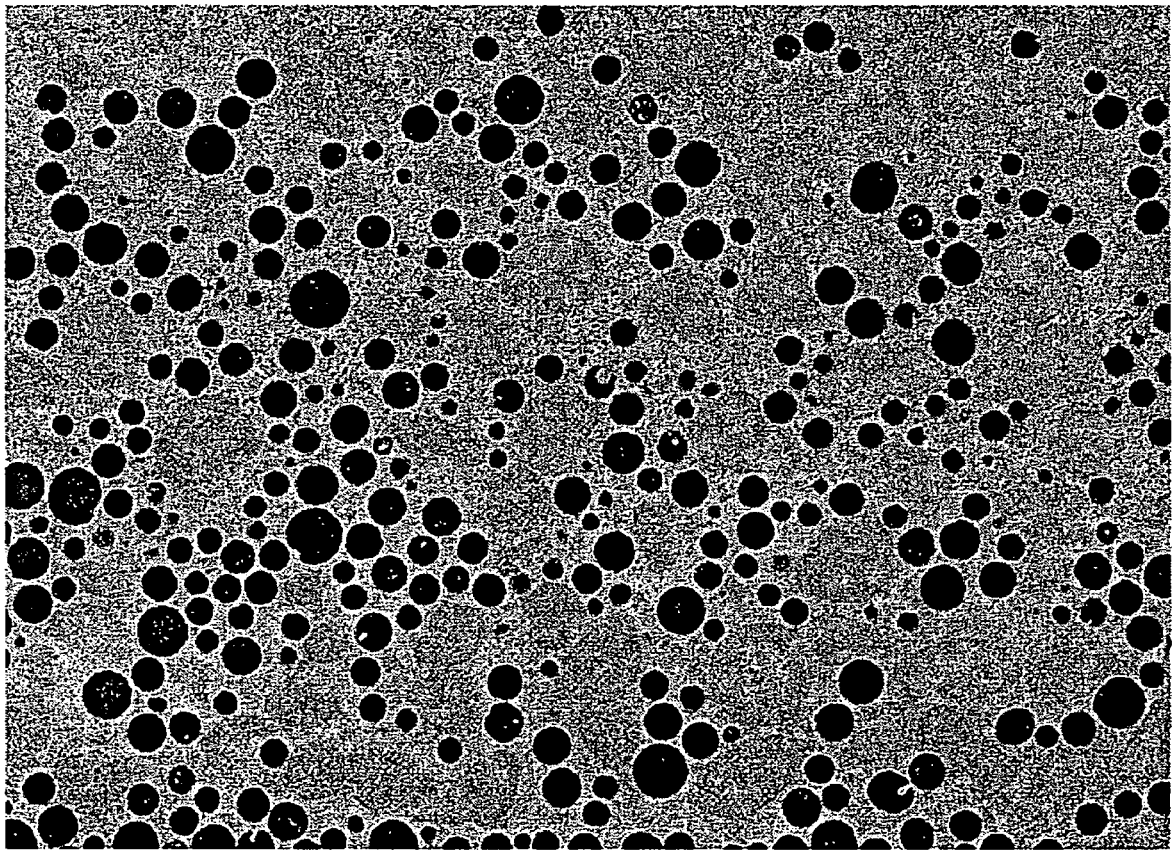
FIG. 9 is a photomicrograph of an abrasive wear-resistant material that embodies teachings of the present invention and that includes tungsten carbide particles substantially randomly dispersed throughout a matrix.

The illustrations presented herein, with the exception of FIG. 9, are not meant to be actual views of any particular material, apparatus, system, or method, but are merely idealized representations which are employed to describe the present invention. Additionally, elements common between figures may retain the same numerical designation.

Figure 5:
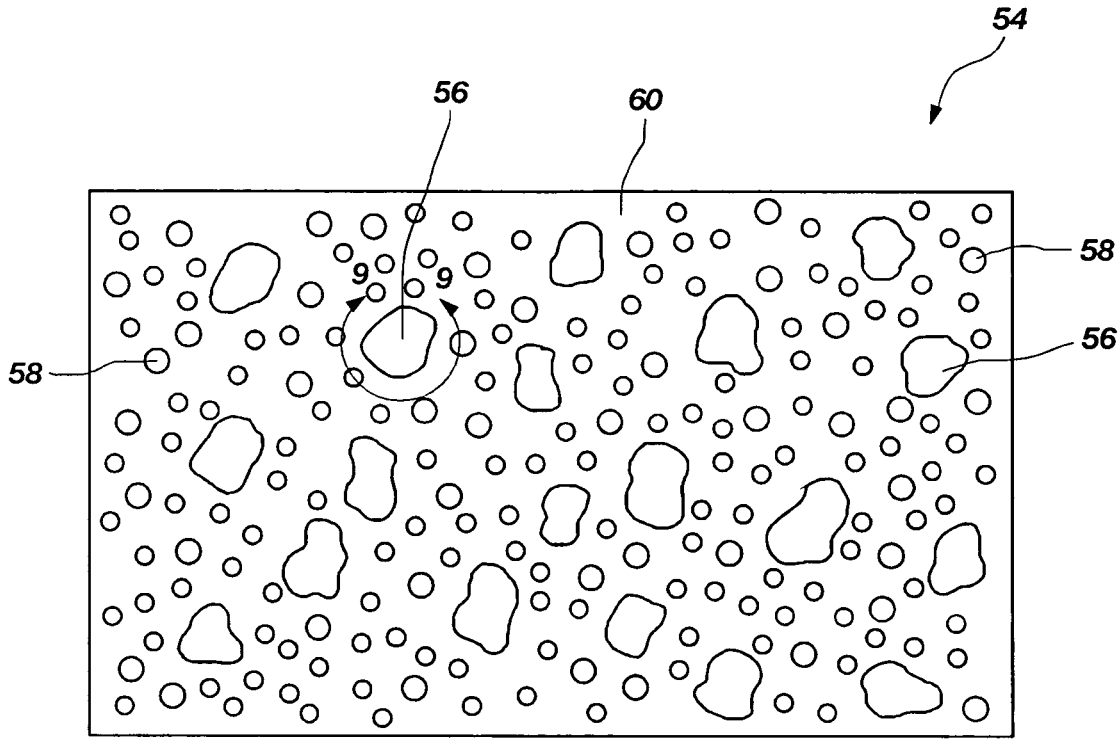
FIG. 5 is a representation of a photomicrograph of an abrasive wear-resistant material that embodies teachings of the present invention and that includes tungsten carbide particles substantially randomly dispersed throughout a matrix.

FIG. 5 represents a polished and etched surface of an abrasive wear-resistant material 54 that embodies teachings of the present invention. FIG. 9 is an actual photomicrograph of a polished and etched surface of an abrasive wear-resistant material that embodies teachings of the present invention. Referring to FIG. 5, the abrasive wear-resistant material 54 includes a plurality of sintered tungsten carbide pellets 56 and a plurality of cast tungsten carbide granules 58 substantially randomly dispersed throughout a matrix material 60. Each sintered tungsten carbide pellet 56 may have a generally spherical pellet configuration. The term "pellet" as used herein means any particle having a generally spherical shape. Pellets are not true spheres, but lack the corners, sharp edges, and angular projections commonly found in crushed and other non-spherical tungsten carbide particles. In some embodiments of the present invention, the cast tungsten carbide granules may be or include cast tungsten carbide pellets, as shown in FIG. 9.

Corners, sharp edges, and angular projections may produce residual stresses, which may cause tungsten carbide material in the regions of the particles proximate the residual stresses to melt at lower temperatures during application of the abrasive wear-resistant material 54 to a surface of a drill bit. Melting or partial melting of the tungsten carbide material during application may facilitate atomic diffusion between the tungsten carbide particles and the surrounding matrix material. As previously discussed herein, atomic diffusion between the matrix material 60 and the sintered tungsten carbide pellets 56 and cast tungsten carbide granules 58 may embrittle the matrix material 60 in regions surrounding the tungsten carbide pellets and granules 56, 58 and reduce the hardness of the tungsten carbide pellets and granules 56, 58 in the outer regions thereof. Such atomic diffusion may degrade the overall physical properties of the abrasive wear-resistant material 54. The use of sintered tungsten carbide pellets 56 (and, optionally, cast tungsten carbide granules 58) instead of conventional tungsten carbide particles that include corners, sharp edges, and angular projections may reduce such atomic diffusion, thereby preserving the physical properties of the matrix material 60 and the sintered tungsten carbide pellets 56 (and, optionally, the cast tungsten carbide granules 58) during application of the abrasive wear-resistant material 54 to the surfaces of drill bits and other tools.

The matrix material 60 may comprise between about 20% and about 60% by weight of the abrasive wear-resistant material 54. More particularly, the matrix material 60 may comprise between about 35% and about 45% by weight of the abrasive wear-resistant material 54. The plurality of sintered tungsten carbide pellets 56 may comprise between about 30% and about 55% by weight of the abrasive wear-resistant material 54. Furthermore, the plurality of cast tungsten carbide granules 58 may comprise less than about 35% by weight of the abrasive wear-resistant material 54. More particularly, the plurality of cast tungsten carbide granules 58 may comprise between about 10% and about 35% by weight of the abrasive wear-resistant material 54. For example, the matrix material 60 may be about 40% by weight of the abrasive wear-resistant material 54, the plurality of sintered tungsten carbide pellets 56 may be about 48% by weight of the abrasive wear-resistant material 54, and the plurality of cast tungsten carbide granules 58 may be about 12% by weight of the abrasive wear-resistant material 54.

The sintered tungsten carbide pellets 56 may be larger in size than the cast tungsten carbide granules 58. Furthermore, the number of cast tungsten carbide granules 58 per unit volume of the abrasive wear-resistant material 54 may be higher than the number of sintered tungsten carbide pellets 56 per unit volume of the abrasive wear-resistant material 54.

The sintered tungsten carbide pellets 56 may include −20 ASTM mesh pellets. As used herein, the phrase "−20 ASTM mesh pellets" means pellets that are capable of passing through an ASTM No. 20 U.S.A. standard testing sieve. Such sintered tungsten carbide pellets may have an average diameter of less than about 850 microns. The average diameter of the sintered tungsten carbide pellets 56 may be between about 1.1 times and about 5 times greater than the average diameter of the cast tungsten carbide granules 58. The cast tungsten carbide granules 58 may include −40 ASTM mesh granules. As used herein, the phrase "−40 ASTM mesh granules" means granules that are capable of passing through an ASTM No. 40 U.S.A. standard testing sieve. More particularly, the cast tungsten carbide granules 58 may include −100 ASTM mesh granules. As used herein, the phrase "−100 ASTM mesh granules" means granules that are capable of passing through an ASTM No. 100 U.S.A. standard testing sieve. Such cast tungsten carbide granules may have an average diameter of less than about 150 microns.

As an example, the sintered tungsten carbide pellets 56 may include −60/+80 ASTM mesh pellets, and the cast tungsten carbide granules 58 may include −100/+270 ASTM mesh granules. As used herein, the phrase "−60/+80 ASTM mesh pellets" means pellets that are capable of passing through an ASTM No. 60 U.S.A. standard testing sieve, but incapable of passing through an ASTM No. 80 U.S.A. standard testing sieve. Such sintered tungsten carbide pellets may have an average diameter of less than about 250 microns and greater than about 180 microns. Furthermore, the phrase "−100/+270 ASTM mesh granules," as used herein, means granules capable of passing through an ASTM No. 100 U.S.A. standard testing sieve, but incapable of passing through an ASTM No. 270 U.S.A. standard testing sieve. Such cast tungsten carbide granules 58 may have an average diameter in a range from approximately 50 microns to about 150 microns.

As another example, the plurality of sintered tungsten carbide pellets 56 may include a plurality of −60/+80 ASTM mesh sintered tungsten carbide pellets and a plurality of −120/+270 ASTM mesh sintered tungsten carbide pellets. The plurality of −60/+80 ASTM mesh sintered tungsten carbide pellets may comprise between about 30% and about 40% by weight of the abrasive wear-resistant material 54, and the plurality of −120/+270 ASTM mesh sintered tungsten carbide pellets may comprise between about 15% and about 25% by weight of the abrasive wear-resistant material 54. As used herein, the phrase "−120/+270 ASTM mesh pellets," as used herein, means pellets capable of passing through an ASTM No. 120 U.S.A. standard testing sieve, but incapable of passing through an ASTM No. 270 U.S.A. standard testing sieve. Such sintered tungsten carbide pellets 56 may have an average diameter in a range from approximately 50 microns to about 125 microns.

In one particular embodiment, set forth merely as an example, the abrasive wear-resistant material 54 may include about 40% by weight matrix material 60, about 48% by weight −20/+30 ASTM mesh sintered tungsten carbide pellets 56, and about 12% by weight −140/+325 ASTM mesh cast tungsten carbide granules 58. As used herein, the phrase "−20/+30 ASTM mesh pellets" means pellets that are capable of passing through an ASTM No. 20 U.S.A. standard testing sieve, but incapable of passing through an ASTM No. 30 U.S.A. standard testing sieve. Similarly, the phrase "−140/+325 ASTM mesh pellets" means pellets that are capable of passing through an ASTM No. 140 U.S.A. standard testing sieve, but incapable of passing through an ASTM No. 325 U.S.A. standard testing sieve. The matrix material 60 may include a nickel-based alloy, which may further include one or more additional elements such as, for example, chromium, boron, and silicon. The matrix material 60 also may have a melting point of less than about 1100° C., and may exhibit a hardness of between about 35 and about 60 on the Rockwell C Scale. More particularly, the matrix material 60 may exhibit a hardness of between about 40 and about 55 on the Rockwell C Scale. For example, the matrix material 60 may exhibit a hardness of about 40 on the Rockwell C Scale.

Cast granules and sintered pellets of carbides other than tungsten carbide also may be used to provide abrasive wear-resistant materials that embody teachings of the present invention. Such other carbides include, but are not limited to, chromium carbide, molybdenum carbide, niobium carbide, tantalum carbide, titanium carbide, and vanadium carbide.

The matrix material 60 may comprise a metal alloy material having a melting point that is less than about 1100° C. Furthermore, each sintered tungsten carbide pellet 56 of the plurality of sintered tungsten carbide pellets 56 may comprise a plurality of tungsten carbide particles bonded together with a binder alloy having a melting point that is greater than about 1200° C. For example, the binder alloy may comprise a cobalt-based metal alloy material or a nickel-based alloy material having a melting point that is greater than about 1200° C. In this configuration, the matrix material 60 may be substantially melted during application of the abrasive wear-resistant material 54 to a surface of a drilling tool such as a drill bit without substantially melting the cast tungsten carbide granules 58, or the binder alloy or the tungsten carbide particles of the sintered tungsten carbide pellets 56. This enables the abrasive wear-resistant material 54 to be applied to a surface of a drilling tool at lower temperatures to minimize atomic diffusion between the sintered tungsten carbide pellets 56 and the matrix material 60 and between the cast tungsten carbide granules 58 and the matrix material 60.

As previously discussed herein, minimizing atomic diffusion between the matrix material 60 and the sintered tungsten carbide pellets 56 and cast tungsten carbide granules 58, helps to preserve the chemical composition and the physical properties of the matrix material 60, the sintered tungsten carbide pellets 56, and the cast tungsten carbide granules 58 during application of the abrasive wear-resistant material 54 to the surfaces of drill bits and other tools.

The matrix material 60 also may include relatively small amounts of other elements, such as carbon, chromium, silicon, boron, iron, and nickel. Furthermore, the matrix material 60 also may include a flux material such as silicomanganese, an alloying element such as niobium, and a binder such as a polymer material.

Figure 6:
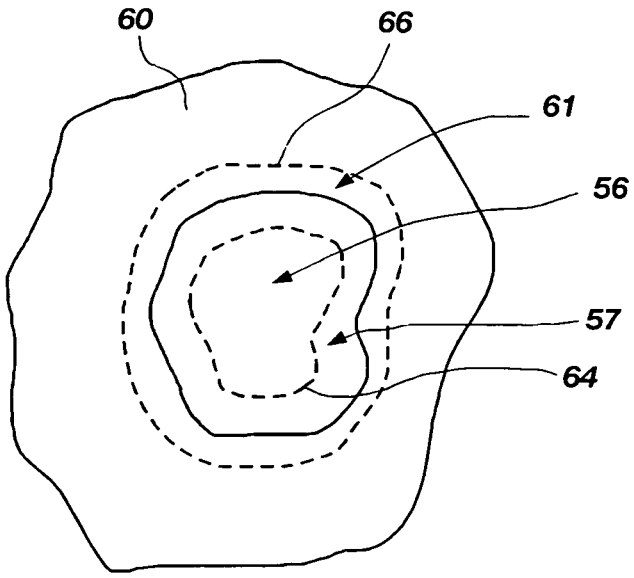
FIG. 6 is an enlarged view of a tungsten carbide particle shown in FIG. 5.

FIG. 6 is an enlarged view of a sintered tungsten carbide pellet 56 shown in FIG. 5. The hardness of the sintered tungsten carbide pellet 56 may be substantially consistent throughout the pellet. For example, the sintered tungsten carbide pellet 56 may include a peripheral or outer region 57 of the sintered tungsten carbide pellet 56. The outer region 57 may roughly include the region of the sintered tungsten carbide pellet 56 outside the phantom line 64. The sintered tungsten carbide pellet 56 may exhibit a first average hardness in the central region of the pellet enclosed by the phantom line 64, and a second average hardness at locations within the peripheral region 57 of the pellet outside the phantom line 64. The second average hardness of the sintered tungsten carbide pellet 56 may be greater than about 99% of the first average hardness of the sintered tungsten carbide pellet 56. As an example, the first average hardness may be about 91 on the Rockwell A Scale and the second average hardness may be about 90 on the Rockwell A Scale. Moreover, the fracture toughness of the matrix material 60 within the region 61 proximate the sintered tungsten carbide pellet 56 and enclosed by the phantom line 66 may be substantially similar to the fracture toughness of the matrix material 60 outside the phantom line 66.

Commercially available metal alloy materials that may be used as the matrix material 60 in the abrasive wear-resistant material 54 are sold by Broco, Inc., of Rancho Cucamonga, Calif. under the trade names VERSALLOY® 40 and VERSALLOY® 50. Commercially available sintered tungsten carbide pellets 56 and cast tungsten carbide granules 58 that may be used in the abrasive wear-resistant material 54 are sold by Sulzer Metco WOKA GmbH, of Barchfeld, Germany.

The sintered tungsten carbide pellets 56 may have relatively high fracture toughness relative to the cast tungsten carbide granules 58, while the cast tungsten carbide granules 58 may have relatively high hardness relative to the sintered tungsten carbide pellets 56. By using matrix materials 60 as described herein, the fracture toughness of the sintered tungsten carbide pellets 56 and the hardness of the cast tungsten carbide granules 58 may be preserved in the abrasive wear-resistant material 54 during application of the abrasive wear-resistant material 54 to a drill bit or other drilling tool, thereby providing an abrasive wear-resistant material 54 that is improved relative to abrasive wear-resistant materials known in the art.

Figure 1:
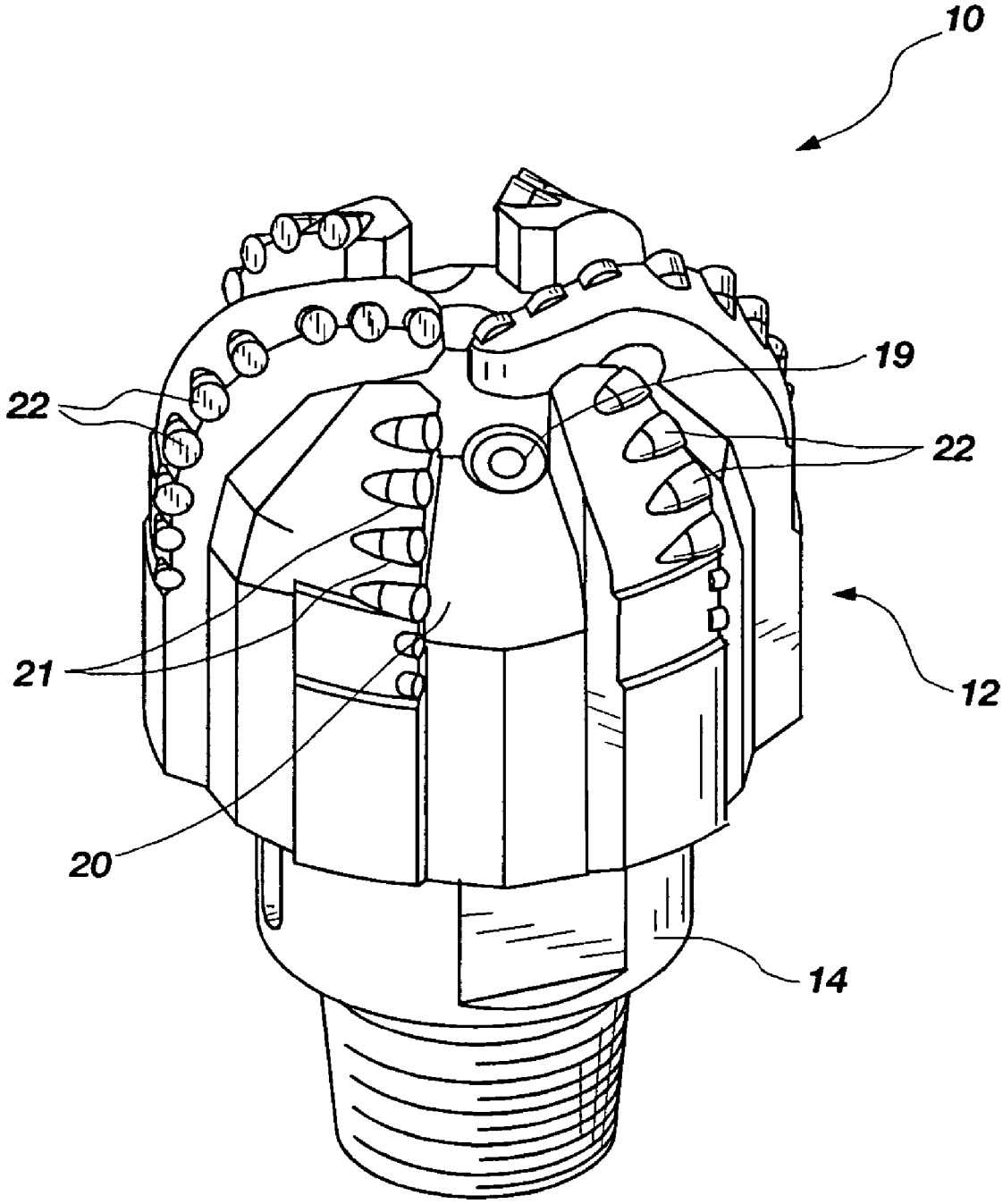
FIG. 1 (PRIOR ART)
FIG. 1 is a perspective view of a rotary type drill bit that includes cutting elements.
Figure 2:
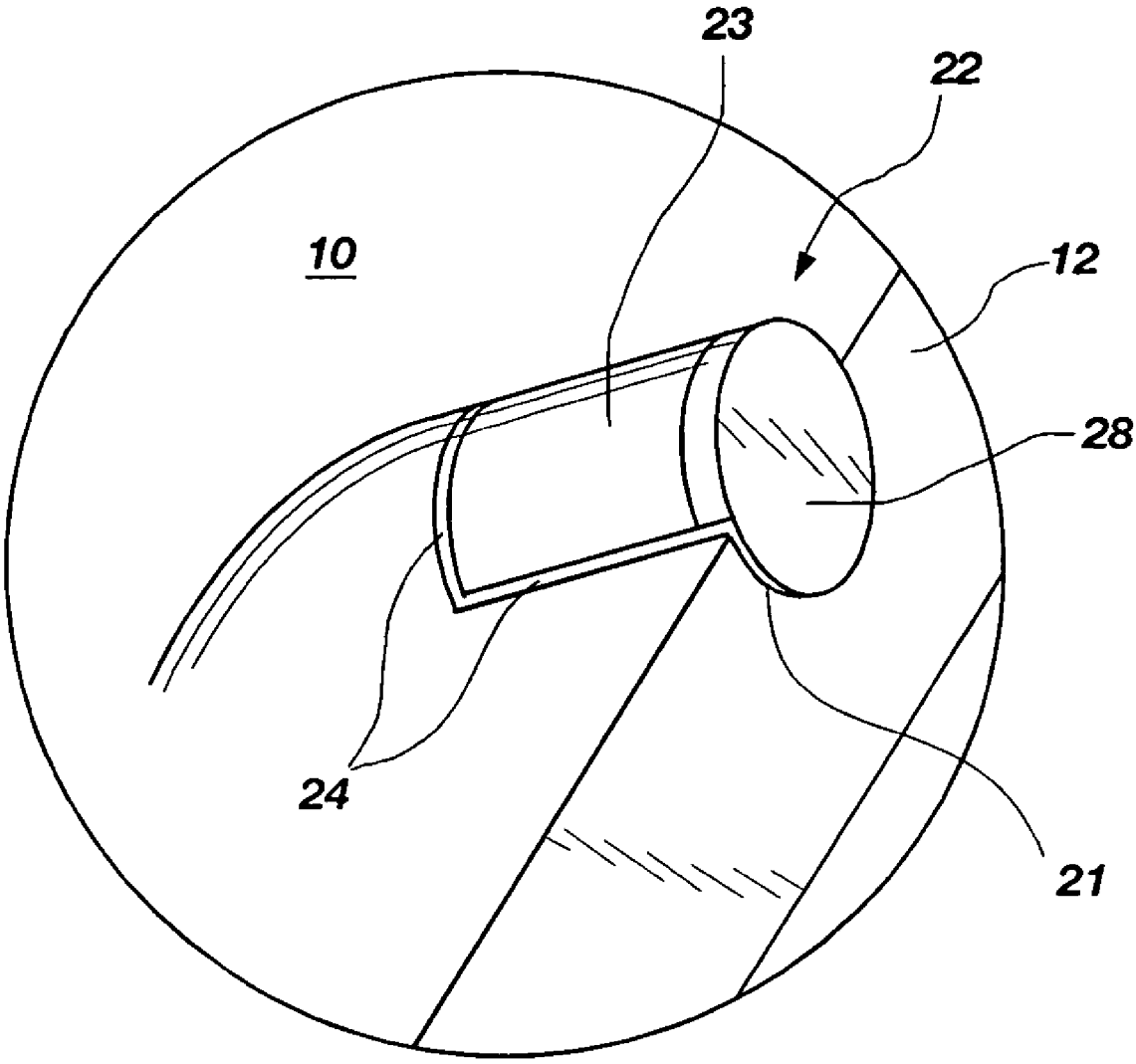
FIG. 2 (PRIOR ART)
FIG. 2 is an enlarged view of a cutting element of the drill bit shown in FIG. 1.
Figure 3:
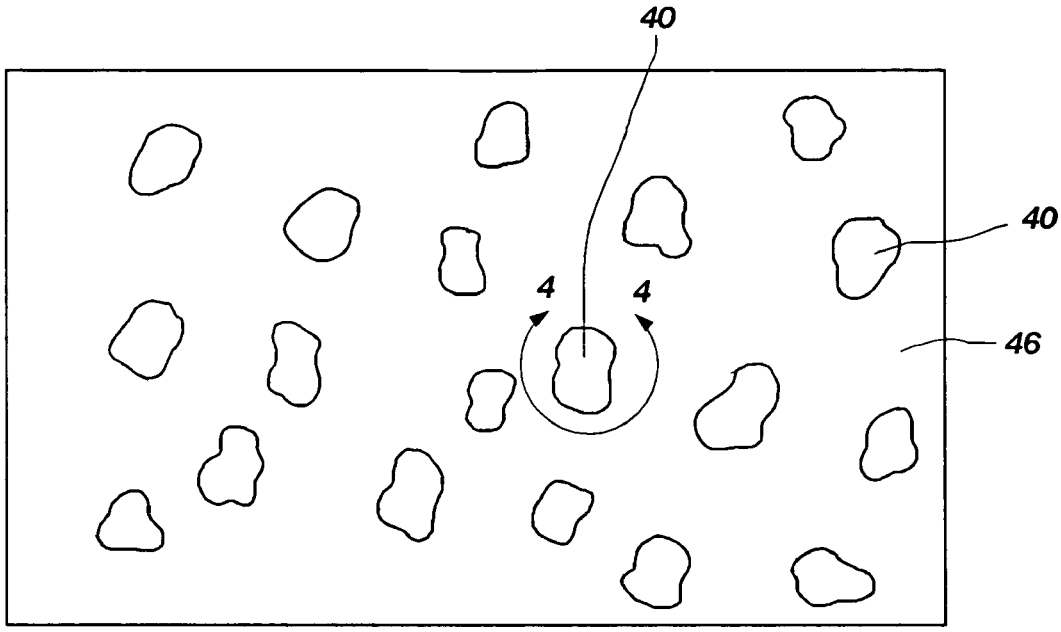
FIG. 3 (PRIOR ART)
FIG. 3 is a representation of a photomicrograph of an abrasive wear-resistant material that includes tungsten carbide particles substantially randomly dispersed throughout a matrix material.
Figure 4:
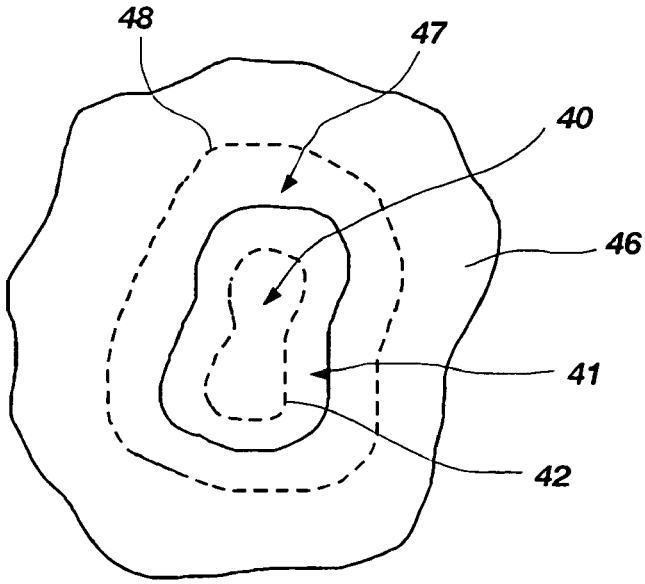
FIG. 4 (PRIOR ART)
FIG. 4 is an enlarged view of a tungsten carbide particle shown in FIG. 3.

Abrasive wear-resistant materials that embody teachings of the present invention, such as the abrasive wear-resistant material 54 illustrated in FIGS. 5 and 6, may be applied to selected areas on surfaces of rotary drill bits (such as the rotary drill bit 10 shown in FIG. 1), rolling cutter drill bits (commonly referred to as "roller cone" drill bits), and other drilling tools that are subjected to wear such as ream-while-drilling tools and expandable reamer blades, all such apparatuses and others being encompassed, as previously indicated, within the term "drill bit."

Certain locations on a surface of a drill bit may require relatively higher hardness, while other locations on the surface of the drill bit may require relatively higher fracture toughness. The relative weight percentages of the matrix material 60, the plurality of sintered tungsten carbide pellets 56, and the plurality of cast tungsten carbide granules 58 may be selectively varied to provide an abrasive wear-resistant material 54 that exhibits physical properties tailored to a particular tool or to a particular area on a surface of a tool. For example, the surfaces of cutting teeth on a rolling cutter type drill bit may be subjected to relatively high impact forces in addition to frictional-type abrasive or grinding forces. Therefore, abrasive wear-resistant material 54 applied to the surfaces of the cutting teeth may include a higher weight percentage of sintered tungsten carbide pellets 56 in order to increase the fracture toughness of the abrasive wear-resistant material 54. In contrast, the gage surfaces of a drill bit may be subjected to relatively little impact force but relatively high frictional-type abrasive or grinding forces. Therefore, abrasive wear-resistant material 54 applied to the gage surfaces of a drill bit may include a higher weight percentage of cast tungsten carbide granules 58 in order to increase the hardness of the abrasive wear-resistant material 54.

In addition to being applied to selected areas on surfaces of drill bits and drilling tools that are subjected to wear, the abrasive wear-resistant materials that embody teachings of the present invention may be used to protect structural features or materials of drill bits and drilling tools that are relatively more prone to wear.

Figure 7A:
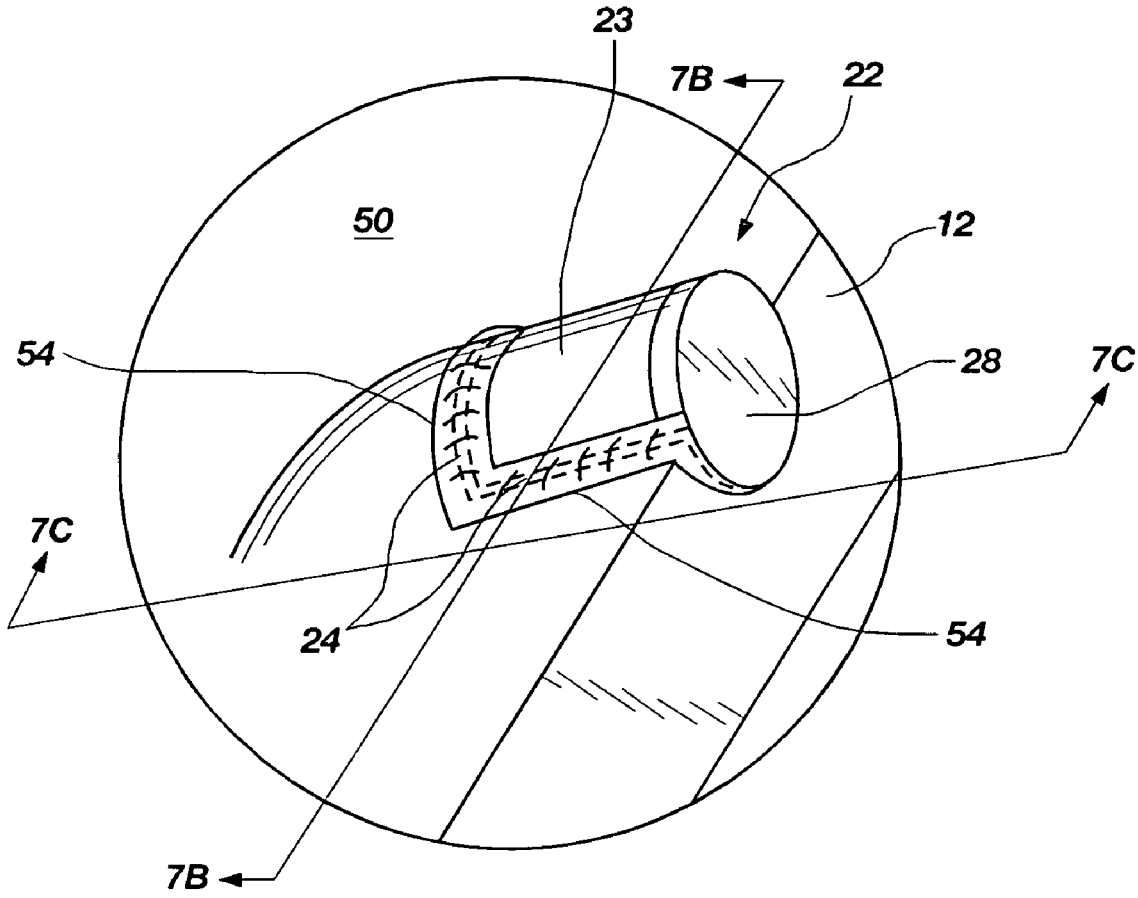
FIG. 7A is an enlarged view of a cutting element of a drill bit that embodies teachings of the present invention.

A portion of a representative rotary drill bit 50 that embodies teachings of the present invention is shown in FIG. 7A. The rotary drill bit 50 is structurally similar to the rotary drill bit 10 shown in FIG. 1, and includes a plurality of cutting elements 22 positioned and secured within pockets provided on the outer surface of a bit body 12. As illustrated in FIG. 7A, each cutting element 22 may be secured to the bit body 12 of the drill bit 50 along an interface therebetween. A bonding material 24 such as, for example, an adhesive or brazing alloy may be provided at the interface and used to secure and attach each cutting element 22 to the bit body 12. The bonding material 24 may be less resistant to wear than the materials of the bit body 12 and the cutting elements 22. Each cutting element 22 may include a polycrystalline diamond compact table 28 attached and secured to a cutting element body or substrate 23 along an interface.

The rotary drill bit 50 further includes an abrasive wear-resistant material 54 disposed on a surface of the drill bit 50. Moreover, regions of the abrasive wear-resistant material 54 may be configured to protect exposed surfaces of the bonding material 24.

Figure 7B:
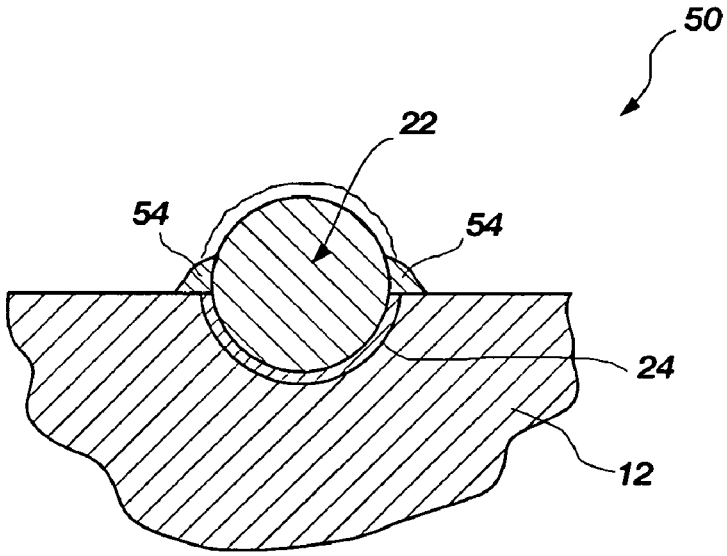
FIG. 7B is a lateral cross-sectional view of the cutting element shown in FIG. 7A taken along section line 7B-7B therein.

FIG. 7B is a lateral cross-sectional view of the cutting element 22 shown in FIG. 7A taken along section line 7B-7B therein. As illustrated in FIG. 7B, continuous portions of the abrasive wear-resistant material 54 may be bonded both to a region of the outer surface of the bit body 12 and a lateral surface of the cutting element 22 and each continuous portion may extend over at least a portion of the interface between the bit body 12 and the lateral sides of the cutting element 22.

Figure 7C:
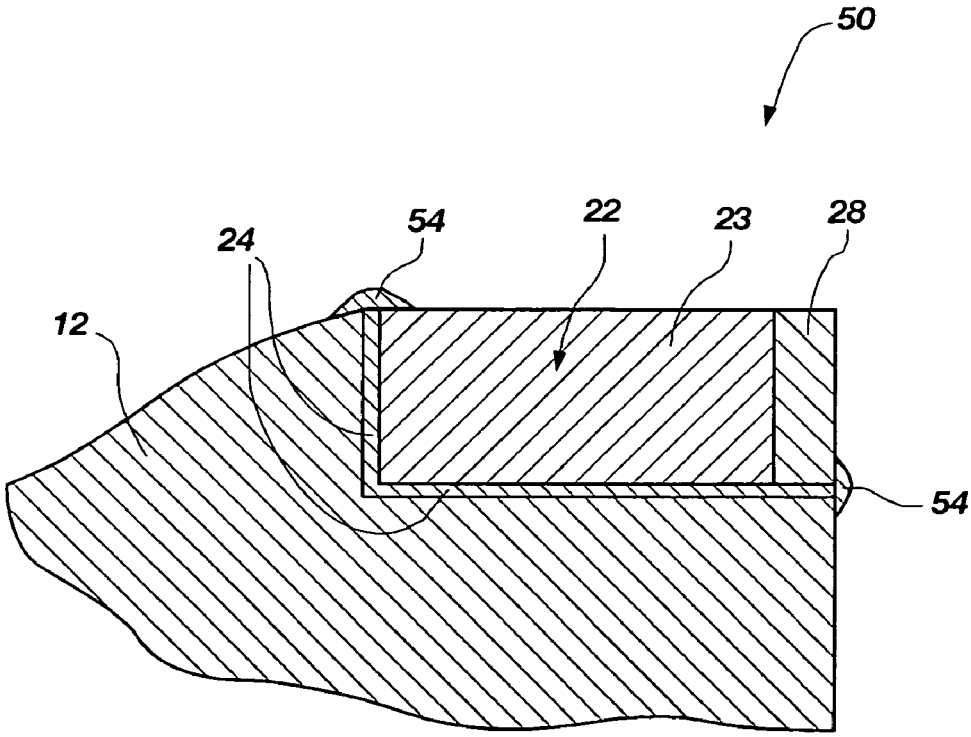
FIG. 7C is a longitudinal cross-sectional view of the cutting element shown in FIG. 7A taken along section line 7C-7C therein.

FIG. 7C is a longitudinal cross-sectional view of the cutting element 22 shown in FIG. 7A taken along section line 7C-7C therein. As illustrated in FIG. 7C, another continuous portion of the abrasive wear-resistant material 54 may be bonded both to a region of the outer surface of the bit body 12 and a lateral surface of the cutting element 22 and may extend over at least a portion of the interface between the bit body 12 and the longitudinal end surface of the cutting element 22 opposite the polycrystalline diamond compact table 28. Yet another continuous portion of the abrasive wear-resistant material 54 may be bonded both to a region of the outer surface of the bit body 12 and a portion of the exposed surface of the polycrystalline diamond compact table 28 and may extend over at least a portion of the interface between the bit body 12 and the face of the polycrystalline diamond compact table 28.

In this configuration, the continuous portions of the abrasive wear-resistant material 54 may cover and protect at least a portion of the bonding material 24 disposed between the cutting element 22 and the bit body 12 from wear during drilling operations. By protecting the bonding material 24 from wear during drilling operations, the abrasive wear-resistant material 54 helps to prevent separation of the cutting element 22 from the bit body 12 during drilling operations, damage to the bit body 12, and catastrophic failure of the rotary drill bit 50.

The continuous portions of the abrasive wear-resistant material 54 that cover and protect exposed surfaces of the bonding material 24 may be configured as a bead or beads of abrasive wear-resistant material 54 provided along and over the edges of the interfacing surfaces of the bit body 12 and the cutting element 22.

Figure 8A:
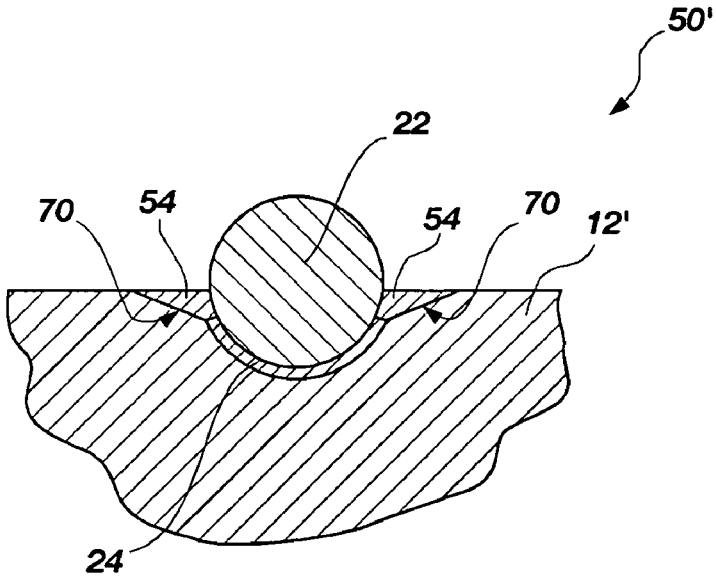
FIG. 8A is a lateral cross-sectional view like that of FIG. 7B illustrating another cutting element of a drill bit that embodies teachings of the present invention.
Figure 8B:
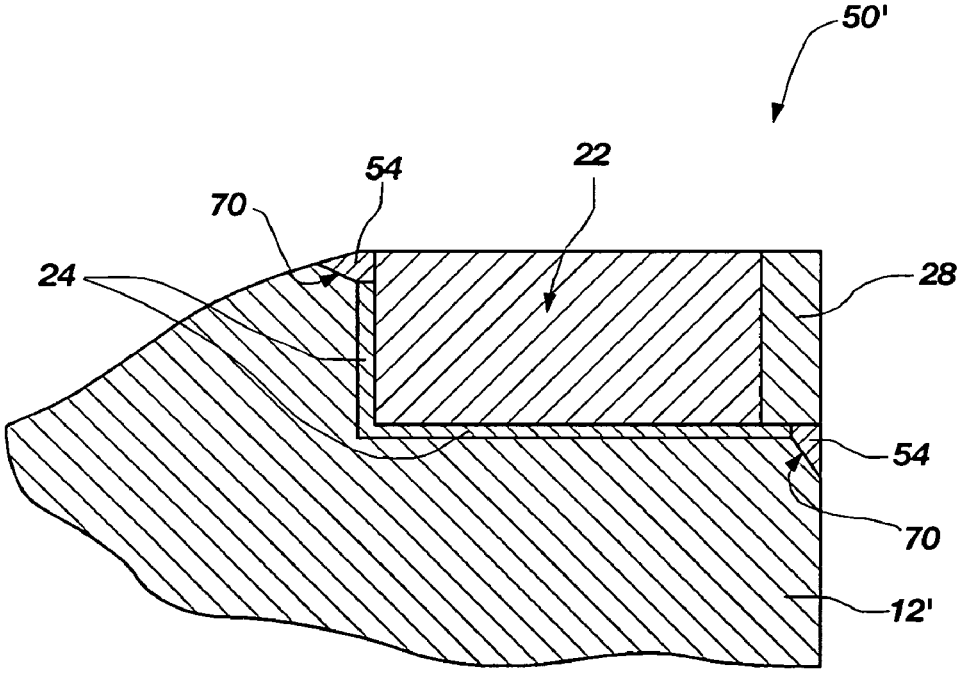
FIG. 8B is a longitudinal cross-sectional view of the cutting element shown in FIG. 8A.

A lateral cross-sectional view of a cutting element 22 of another representative rotary drill bit 50' that embodies teachings of the present invention is shown in FIGS. 8A and 8B. The rotary drill bit 50' is structurally similar to the rotary drill bit 10 shown in FIG. 1, and includes a plurality of cutting elements 22 positioned and secured within pockets provided on the outer surface of a bit body 12'. The cutting elements 22 of the rotary drill bit 50' also include continuous portions of the abrasive wear-resistant material 54 that cover and protect exposed surfaces of a bonding material 24 along the edges of the interfacing surfaces of the bit body 12' and the cutting element 22, as discussed previously herein in relation to the rotary drill bit 50 shown in FIGS. 7A-7C.

As illustrated in FIG. 8A, however, recesses 70 are provided in the outer surface of the bit body 12' adjacent the pockets within which the cutting elements 22 are secured. In this configuration, a bead or beads of abrasive wear-resistant material 54 may be provided within the recesses 70 along the edges of the interfacing surfaces of the bit body 12 and the cutting element 22. By providing the bead or beads of abrasive wear-resistant material 54 within the recesses 70, the extent to which the bead or beads of abrasive wear-resistant material 54 protrude from the surface of the rotary drill bit 50' may be minimized. As a result, abrasive and erosive materials and flows to which the bead or beads of abrasive wear-resistant material 54 are subjected during drilling operations may be reduced.

The abrasive wear-resistant material 54 may be used to cover and protect interfaces between any two structures or features of a drill bit or other drilling tool. For example, the interface between a bit body and a periphery of wear knots or any type of insert in the bit body. In addition, the abrasive wear-resistant material 54 is not limited to use at interfaces between structures or features and may be used at any location on any surface of a drill bit or drilling tool that is subjected to wear.

Abrasive wear-resistant materials that embody teachings of the present invention, such as the abrasive wear-resistant material 54, may be applied to the selected surfaces of a drill bit or drilling tool using variations of techniques known in the art. For example, a pre-application abrasive wear-resistant material that embodies teachings of the present invention may be provided in the form of a welding rod. The welding rod may comprise a solid cast or extruded rod consisting of the abrasive wear-resistant material 54. Alternatively, the welding rod may comprise a hollow cylindrical tube formed from the matrix material 60 and filled with a plurality of sintered tungsten carbide pellets 56 and a plurality of cast tungsten carbide granules 58. An oxyacetylene torch or any other type of welding torch may be used to heat at least a portion of the welding rod to a temperature above the melting point of the matrix material 60 and less than about 1200° C. to melt the matrix material 60. This may minimize the extent of atomic diffusion occurring between the matrix material 60 and the sintered tungsten carbide pellets 56 and cast tungsten carbide granules 58.

The rate of atomic diffusion occurring between the matrix material 60 and the sintered tungsten carbide pellets 56 and cast tungsten carbide granules 58 is at least partially a function of the temperature at which atomic diffusion occurs. The extent of atomic diffusion, therefore, is at least partially a function of both the temperature at which atomic diffusion occurs and the time for which atomic diffusion is allowed to occur. Therefore, the extent of atomic diffusion occurring between the matrix material 60 and the sintered tungsten carbide pellets 56 and cast tungsten carbide granules 58 may be controlled by controlling the distance between the torch and the welding rod (or pre-application abrasive wear-resistant material), and the time for which the welding rod is subjected to heat produced by the torch.

Oxyacetylene and atomic hydrogen torches may be capable of heating materials to temperatures in excess of 1200° C. It may be beneficial to slightly melt the surface of the drill bit or drilling tool to which the abrasive wear-resistant material 54 is to be applied just prior to applying the abrasive wear-resistant material 54 to the surface. For example, an oxyacetylene and atomic hydrogen torch may be brought in close proximity to a surface of a drill bit or drilling tool and used to heat to the surface to a sufficiently high temperature to slightly melt or "sweat" the surface. The welding rod comprising pre-application wear-resistant material then may be brought in close proximity to the surface and the distance between the torch and the welding rod may be adjusted to heat at least a portion of the welding rod to a temperature above the melting point of the matrix material 60 and less than about 1200° C. to melt the matrix material 60. The molten matrix material 60, at least some of the sintered tungsten carbide pellets 56, and at least some of the cast tungsten carbide granules 58 may be applied to the surface of the drill bit, and the molten matrix material 60 may be solidified by controlled cooling. The rate of cooling may be controlled to control the microstructure and physical properties of the abrasive wear-resistant material 54.

Alternatively, the abrasive wear-resistant material 54 may be applied to a surface of a drill bit or drilling tool using an arc welding technique, such as a plasma transferred arc welding technique. For example, the matrix material 60 may be provided in the form of a powder (small particles of matrix material 60). A plurality of sintered tungsten carbide pellets 56 and a plurality of cast tungsten carbide granules 58 may be mixed with the powdered matrix material 60 to provide a pre-application wear-resistant material in the form of a powder mixture. A plasma transferred arc welding machine then may be used to heat at least a portion of the pre-application wear-resistant material to a temperature above the melting point of the matrix material 60 and less than about 1200° C. to melt the matrix material 60.

Plasma transferred arc welding machines typically include a non-consumable electrode that may be brought in close proximity to the substrate (drill bit or other drilling tool) to which material is to be applied. A plasma-forming gas is provided between the substrate and the non-consumable electrode, typically in the form of a column of flowing gas. An arc is generated between the electrode and the substrate to generate a plasma in the plasma-forming gas. The powdered pre-application wear-resistant material may be directed through the plasma and onto a surface of the substrate using an inert carrier gas. As the powdered pre-application wear-resistant material passes through the plasma it is heated to a temperature at which at least some of the wear-resistant material will melt. Once the at least partially molten wear-resistant material has been deposited on the surface of the substrate, the wear-resistant material is allowed to solidify. Such plasma transferred arc welding machines are known in the art and commercially available.

The temperature to which the pre-application wear-resistant material is heated as the material passes through the plasma may be at least partially controlled by controlling the current passing between the electrode and the substrate. For example, the current may be pulsed at a selected pulse rate between a high current and a low current. The low current may be selected to be sufficiently high to melt at least the matrix material 60 in the pre-application wear-resistant material, and the high current may be sufficiently high to melt or sweat the surface of the substrate. Alternatively, the low current may be selected to be too low to melt any of the pre-application wear-resistant material, and the high current may be sufficiently high to heat at least a portion of the pre-application wear-resistant material to a temperature above the melting point of the matrix material 60 and less than about 1200° C. to melt the matrix material 60. This may minimize the extent of atomic diffusion occurring between the matrix material 60 and the sintered tungsten carbide pellets 56 and cast tungsten carbide granules 58.

Other welding techniques, such as metal inert gas (MIG) arc welding techniques, tungsten inert gas (TIG) arc welding techniques, and flame spray welding techniques are known in the art and may be used to apply the abrasive wear-resistant material 54 to a surface of a drill bit or drilling tool.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. A device for use in drilling subterranean formations, the device comprising:

a first structure;

a second structure secured to the first structure along an interface;

a bonding material disposed between the first structure and the second structure at the interface, the bonding material securing the first structure and the second structure together; and an abrasive wear-resistant material disposed on a surface of the device, at least a continuous portion of the wear-resistant material being bonded to a surface of the first structure and a surface of the second structure and extending over the interface between the first structure and the second structure and covering the bonding material, the abrasive wear-resistant material comprising:

a matrix material having a melting temperature of less than about 1100° C.;

a plurality of sintered tungsten carbide pellets substantially randomly dispersed throughout the matrix material, wherein a chemical composition of each pellet of the plurality of sintered tungsten carbide pellets is at least substantially homogenous throughout each respective pellet and wherein each pellet of the plurality of sintered tungsten carbide pellets has a first average hardness in a central region of the pellet and a second average hardness in a peripheral region of the pellet, the second hardness being greater than about 99% of the first hardness, the first hardness and the second hardness being different; and a plurality of cast tungsten carbide granules substantially randomly dispersed throughout the matrix material.

2. The device of claim 1, wherein the first structure comprises a drill bit and the second structure comprises a cutting element.

3. The device of claim 2, wherein the bonding material comprises a brazing alloy.

4. The device of claim 2, wherein the drill bit further comprises a bit body having an outer surface, the bit body comprising at least one recess formed in the outer surface adjacent the interface between the drill bit and the cutting element, at least a portion of the abrasive wear-resistant material being disposed within the at least one recess.

5. The device of claim 2, wherein the drill bit further comprises a bit body having an outer surface and a pocket therein, at least a portion of the cutting element being disposed within the pocket, the interface extending along adjacent surfaces of the bit body and the cutting element.

6. The device of claim 1, wherein the matrix material of the abrasive wear-resistant material comprises at least 75% nickel by weight.

7. The device of claim 6, wherein the matrix material of the abrasive wear-resistant material further comprises at least one of chromium, nickel, iron, boron, and silicon.

8. The device of claim 1, wherein the first hardness and the second hardness are greater than about 89 on a Rockwell A Scale.

9. The device of claim 6, wherein the plurality of sintered tungsten carbide pellets comprises a plurality of −20 ASTM mesh sintered tungsten carbide pellets.

10. The device of claim 9, wherein the plurality of sintered tungsten carbide pellets comprises a plurality of −60/+80 ASTM mesh sintered tungsten carbide pellets.

11. The device of claim 9, wherein the plurality of cast tungsten carbide granules comprises a plurality of −40 ASTM mesh cast tungsten carbide granules.

12. The device of claim 11, wherein the plurality of cast tungsten carbide granules comprises a plurality of −100/+270 ASTM mesh sintered tungsten carbide pellets.

13. A rotary drill bit for drilling subterranean formations comprising:

a bit body;

at least one cutting element secured to the bit body along an interface;

a brazing alloy disposed between the bit body and the at least one cutting element at the interface, the brazing alloy securing the at least one cutting element to the bit body; and an abrasive wear-resistant material disposed on a surface of the rotary drill bit, at least a continuous portion of the wear-resistant material being bonded to an outer surface of the bit body and a surface of the at least one cutting element and extending over the interface between the bit body and the at least one cutting element and covering at least a portion of the brazing alloy, the abrasive wear-resistant material comprising the following materials in pre-application ratios:

a matrix material, the matrix material comprising between about 20% and about 60% by weight of the abrasive wear-resistant material, the matrix material comprising at least 75% nickel by weight, the matrix material having a melting point of less than about 1100° C.;

a plurality of −20 ASTM mesh sintered tungsten carbide pellets substantially randomly dispersed throughout the matrix material, the plurality of sintered tungsten carbide pellets comprising between about 30% and about 55% by weight of the abrasive wear-resistant material, each sintered tungsten carbide pellet comprising a plurality of tungsten carbide particles bonded together with a binder alloy, the binder alloy having a melting point greater than about 1200° C., wherein each pellet of the plurality of sintered tungsten carbide pellets has a first average hardness in a central region of the pellet and a second average hardness in a peripheral region of the pellet, the second hardness being greater than about 99% of the first hardness, the first hardness and the second hardness being different; and a plurality of −40 ASTM mesh cast tungsten carbide granules substantially randomly dispersed throughout the matrix material, the plurality of cast tungsten carbide granules comprising less than about 35% by weight of the abrasive wear-resistant material.

14. The rotary drill bit of claim 13, wherein the bit body comprises a bit body having an outer surface and a pocket therein, at least a portion of the at least one cutting element being disposed within the pocket, the interface extending along adjacent surfaces of the bit body and the at least one cutting element.

15. The rotary drill bit of claim 14, wherein the bit body further comprises at least one recess formed in the outer surface of the bit body adjacent the interface, at least a portion of the abrasive wear-resistant material being disposed within the at least one recess.

16. The rotary drill bit of claim 13, wherein the at least one cutting element comprises a cutting element body and a diamond compact table secured to an end of the cutting element body.

17. The rotary drill bit of claim 13, wherein the plurality of −20 ASTM mesh sintered tungsten carbide pellets comprises a plurality of −60/+80 ASTM mesh sintered tungsten carbide pellets, and wherein the plurality of −40 ASTM mesh cast tungsten carbide granules comprises a plurality of −100/+270 ASTM mesh cast tungsten carbide granules.

18. The rotary drill bit of claim 13, wherein the plurality of −20 ASTM mesh sintered tungsten carbide pellets comprises a plurality of −60/+80 ASTM mesh sintered tungsten carbide pellets and a plurality of −120/+270 ASTM mesh sintered tungsten carbide pellets, the plurality of −60/+80 ASTM mesh sintered tungsten carbide pellets comprising between about 30% and about 35% by weight of the abrasive wear-resistant material, the plurality of −120/+270 ASTM mesh sintered tungsten carbide pellets comprising between about 10% and about 20% by weight of the abrasive wear-resistant material.

* * * * *